US008723041B2

(12) United States Patent
Frigerio et al.

(10) Patent No.: US 8,723,041 B2
(45) Date of Patent: May 13, 2014

(54) ELECTRIC CABLE COMPRISING A FOAMED POLYOLEFINE INSULATION AND MANUFACTURING PROCESS THEREOF

(75) Inventors: Marco Frigerio, Milan (IT); Flavio Casiraghi, Milan (IT); Vincenzo Crisci, Milan (IT); Gianbattista Grasselli, Milan (IT); Jean-Louis Pons, Milan (IT); Alberto Bareggi, Milan (IT)

(73) Assignee: Prysmian Cavi e Sistemi Energia S.R.L., Milan (IT)

( * ) Notice: Subject to any disclaimer, the term of this patent is extended or adjusted under 35 U.S.C. 154(b) by 670 days.

(21) Appl. No.: 12/086,864

(22) PCT Filed: Dec. 22, 2005

(86) PCT No.: PCT/EP2005/013866

§ 371 (c)(1),
(2), (4) Date: Oct. 29, 2008

(87) PCT Pub. No.: WO2007/071274

PCT Pub. Date: Jun. 28, 2007

(65) Prior Publication Data

US 2009/0145627 A1 Jun. 11, 2009

(51) Int. Cl.
*H01B 7/00* (2006.01)

(52) U.S. Cl.
USPC ..... 174/110 R; 174/113 R; 174/120 R; 174/120 SR; 174/120 AR

(58) Field of Classification Search
USPC ..... 174/110 R, 102 SC, 110 PM, 110 FC, 174/102 R, 113 R, 120 R, 120 C, 120 SC
See application file for complete search history.

(56) References Cited

U.S. PATENT DOCUMENTS 3,013,109 A * 12/1961 Gorman et al. ..... 174/113 R
3,098,831 A 7/1963 Carr et al.
3,315,025 A * 4/1967 Tomlinson ..... 174/107

(Continued)

FOREIGN PATENT DOCUMENTS

CN 1345893 A 4/2002
CN 1625787 A 6/2005

(Continued)

OTHER PUBLICATIONS

"Hot Set Test", Italian Standard Regulation, Norma Technica, CEI EN 60811-2-1:May 1999, pp. 8-12.

(Continued)

*Primary Examiner* — William H Mayo, III
(74) *Attorney, Agent, or Firm* — Finnegan, Henderson, Farabow, Garrett & Dunner, L.L.P.

(57) ABSTRACT

A process for manufacturing an electric cable including at least one core including a conductor and an insulating coating surrounding the conductor includes the steps of: providing a polyolefin material, a silane-based cross-linking system and a foaming system including at least one exothermic foaming agent in an amount of 0.1% to 0.5% by weight with respect to the total weight of the polyolefin material; forming a blend with the polyolefin material, the silane-based cross-linking system and the foaming system; and extruding the blend on the conductor to form the insulating coating. An electric cable includes at least one core consisting of a conductor and an insulating coating surrounding the conductor and in contact therewith, the insulating coating consisting of a layer of expanded, silane-cross-linked polyolefin material having an expansion degree of 3% to 40%.

53 Claims, 2 Drawing Sheets

(56) References Cited

U.S. PATENT DOCUMENTS

| | | | | |
|---|---|---|---|---|
| 3,882,209 | A | 5/1975 | Yanagisawa et al. | |
| 3,936,591 | A * | 2/1976 | Smith et al. | 174/116 |
| 4,252,906 | A | 2/1981 | Hosokawa et al. | |
| 4,413,066 | A | 11/1983 | Isaka et al. | |
| 4,443,657 | A * | 4/1984 | Hill et al. | 174/110 FC |
| 4,468,435 | A * | 8/1984 | Shimba et al. | 428/383 |
| 4,591,066 | A | 5/1986 | Moen | |
| 4,604,497 | A * | 8/1986 | Bell et al. | 174/110 F |
| 4,711,811 | A * | 12/1987 | Randa | 428/383 |
| 4,789,589 | A | 12/1988 | Baxter | |
| 5,110,998 | A * | 5/1992 | Muschiatti | 174/24 |
| 5,128,175 | A * | 7/1992 | Yamanishi et al. | 427/515 |
| 5,192,834 | A * | 3/1993 | Yamanishi et al. | 174/120 SR |
| 5,210,377 | A * | 5/1993 | Kennedy et al. | 174/107 |
| 5,302,455 | A | 4/1994 | Wason et al. | |
| 5,574,250 | A * | 11/1996 | Hardie et al. | 174/36 |
| 5,750,931 | A * | 5/1998 | McGregor et al. | 174/110 PM |
| 5,841,072 | A * | 11/1998 | Gagnon | 174/110 F |
| 6,139,957 | A * | 10/2000 | Craton | 428/379 |
| 6,231,919 | B1 * | 5/2001 | Craton | 427/119 |
| 7,105,749 | B2 | 9/2006 | Belli et al. | |
| 7,241,826 | B2 * | 7/2007 | Shiotsuki et al. | 524/404 |
| 2003/0079903 | A1 * | 5/2003 | Scheidecker et al. | 174/110 F |
| 2004/0198886 | A1 * | 10/2004 | Shiotsuki et al. | 524/404 |
| 2005/0217891 | A1 | 10/2005 | Belli et al. | |
| 2010/0151243 | A1 * | 6/2010 | Glew | 428/373 |

FOREIGN PATENT DOCUMENTS

| | | | |
|---|---|---|---|
| EP | 0 167 239 | | 11/1989 |
| JP | 52-71563 | A | 6/1977 |
| JP | 54-55068 | | 5/1979 |
| JP | 58-1530 | | 1/1983 |
| JP | 3-269029 | | 11/1991 |
| JP | 7-122139 | | 5/1995 |
| JP | 9-92055 | | 4/1997 |
| WO | WO 03/088274 | A1 | 10/2003 |

OTHER PUBLICATIONS

"Insulating and sheathing materials of electric cables" Part 1: General application , Italian Standard Regulation, Norma Technica, CEI EN 60811-1-1:Jun. 2001, pp. i-vi and 1-24.

English language translation of Notice of Rejection issued by Japanese Patent Office on Mar. 31, 2011 in corresponding Japanese Application No. 2008-546138.

English translation of JP3-269029, Nov. 29, 1991.

English translation of JP58-1530, Jan. 6, 1983.

English translation of JP9-92055, Apr. 4, 1997.

English translation of JP7-122139, May 12, 1995.

Argentine Office Action dated Jan. 23, 2013, in corresponding application No. P 06 01 05644.

European Opposition for Ep 1 969 609 dated Sep. 17, 2013.

* cited by examiner

ELECTRIC CABLE COMPRISING A FOAMED POLYOLEFINE INSULATION AND MANUFACTURING PROCESS THEREOF

CROSS REFERENCE TO RELATED APPLICATION

This application is a national phase application based on PCT/EP2005/013866, filed Dec. 22, 2005, the content of which is incorporated herein by reference.

BACKGROUND OF THE INVENTION

The present invention relates to an electric cable.

Furthermore, the present invention relates to a manufacturing process of said electric cable.

PRIOR ART

Cables for power transmission are generally provided with a metallic conductor which is surrounded by an insulating coating.

A power cable can be provided with a sheath in a radially external position with respect to the insulating layer. Said is sheath is provided for protecting the cable against mechanical damages.

U.S. Pat. No. 4,789,589 relates to an insulated electrical conductor wire, wherein the insulation surrounding the conductor wire comprises an inner layer of a polyolefin compound and of cellular construction, and an outer layer of a non-cured and non-curable polyvinylchloride.

WO 03/088274 relates to a cable with an insulating coating comprising at least two insulating layers so that, in a radial direction from the inside towards the outside of the cable, the insulating coating comprises at least one insulating layer made of a non-expanded polymeric material and at least one insulating layer made of an expanded polymeric material. In fact, an expanded insulating layer shows discontinuities (i.e., voids within the polymeric material, said voids being filled with air or gas) and could not work properly in the space surrounding the conductor where the electrical field is most relevant.

As reported, for example, by U.S. Pat. No. 4,591,606, cross-linked polyolefin foam is produced by using chemical foaming agents, such as azodicarbonamide, which decompose on being heated and generate gaseous nitrogen. The cross-linking is usually achieved by the aid of a radical former, such as dicumylperoxide. The cross-linking reaction is also achieved with the aid of heat. Cross-linked polyethylene foam manufacturing processes have also been developed, but in this case cross-linking is accomplished with the aid of irradiation. The products of such process have very low densities, thus no applications requiring strength and rigidity can be contemplated. When an organic peroxide is used as a cross-linking agent, control of the process is difficult because foaming and cross-linking process, are both temperature-dependent.

U.S. Pat. No. 3,098,831 relates to cross-linked and expanded polyethylene material useful, inter alia, as electrical insulation. Said polyethylene material is said to have a density of not more than 0.32 g/cm$^3$ (20 pounds per cubic foot). Examples are provided with polyethylene having an expansion degree of 90-95%. The expanded polyethylene is prepared by subjecting cross-linked polyethylene containing a rubber foaming agent to an elevated temperature at which the foaming agent is decomposed and thus causes the polyethylene to expand. The polyethylene starting material may be cross-linked, e.g., by an organic peroxide, the amount of cross-lining agent generally varying from 0.002 to 0.01 mol per 100 grams of polyethylene. Among the foaming agents, azodicarbonamide is exemplified, and about 2 to 15 parts by weight of foaming agent, based on 100 parts of the polyethylene material, are employed.

Generally, a cable for building wiring and/or industrial applications should be installed within walls, and the installation process requires that the cable passes through walls restrictions or, more frequently, that the cable is pulled through conduits, wherein the cable is permanently confined.

In order to be correctly installed with simple and quick operations, a cable needs to be particularly flexible so that it can be inserted into the wall passages and/or wall conduits and follow the bends of the installation path without being damaged.

During customer installation, due to the tortuosity of the installation path and to friction during the pulling operation, the cables for building wiring are generally subjected to tearing or scraping against rough edges and/or surfaces.

Increasing the flexibility of an electric cable can allow to reduce the damages caused by said tearing or scraping actions. As disclosed, for example, in WO 03/088274 cited above, the flexibility of the cable can be advantageously increased by providing the cable with an expanded insulating layer, with favorable results in the installation process thereof.

An increased flexibility can be provided by the expanded insulating layer thanks to the "spongy" nature of the material. In particular, the flexibility of a cable can be maximized when the insulating layer consists of a single layer of expanded material.

In addition, the presence of an expanded coating in a cable decreases the cable weight with advantages in the transport and installation thereof.

Nevertheless, an expanded insulating layer could give rise to problems such as:

- when in contact with the conductor the discontinuities of an expanded material could impair the insulating properties of the layer;
- the expanded material of the insulating coating should have an expansion degree high enough to provide the desired flexibility, but not such to unsuitably weaken the coating from the mechanical point of view.

Another important aspect which is required to be satisfied by a cable is a simple and quick peeling-off of the cable.

The peeling-off property of a cable, for example for building wiring, is a widely felt request of the market since the peeling-off of a cable is an operation which is manually performed by the technical staff. For this reason, said operation is required to be easy and quick to be performed by the operator, taking also into account that it is frequently carried out in narrow spaces and rather uncomfortable conditions.

Typically, a cable sheath is made of a mixture based on polyvinyl chloride (PVC) and comprising, inter alia, a plasticizer. The plasticizer is prone to migrate out of the PVC sheath into the insulating layer altering the composition thereof. In the course of accelerated ageing test, the Applicant has observed that this effect is significant in case of unexpanded insulating layer. As a consequence the composition has impaired electrical (insulating) properties, in view of the polar nature of the plasticizer, weaken mechanical characteristics, and can bring about premature ageing of the cable.

SUMMARY OF THE INVENTION

The Applicant perceived that an expanded polyolefin material could be advantageous as insulating layer for a cable when the polyolefin material is both expanded and cross-linked. The co-existing cross-linking and expansion provide a polyolefin material with improved flexibility and ease of peeling-off without impairing the mechanical properties of the layer formed therewith.

The Applicant has observed that if expanding and cross-linking a polyolefin is attempted, the expansion degree cannot in general be controlled, being either excessive or insufficient.

However, within the present invention the Applicant has found that a properly expanded and cross-linked insulating layer can be obtained by a silane-based cross-linking system and an exothermic foaming agent. The so-obtained insulating layer has an expansion degree advantageous to afford the cable with the above-mentioned features.

In particular, the Applicant has found that a polymer expanded/cross-linked insulating layer improves the ageing stability of a sheathed cable.

Such result is believed to be due to the fact that such insulating layer has a better compatibility with respect to the sheath materials.

DEFINITIONS

For the purpose of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

In the present description the expression "cable core" indicates a structure comprising at least one conductor and a respective electric insulating coating arranged in a position radially external to said conductor.

For the purposes of the present description, the expression "unipolar cable" means a cable provided with a single core as defined above, while the expression "multipolar cable" means a cable provided with at least one pair of said cores. In greater detail, when a multipolar cable has a number of cores equal to two, said cable is technically defined as "bipolar cable", if there are three cores, said cable is known as "tripolar cable", and so on.

In the present description the term "peeling-off of a cable" is used to indicate the removal of all the cable layers which are radially external to the conductor so that it results uncoated to be electrically connected to a conductor of a further cable or to an electrical apparatus, for example.

In the present description, the expression "low voltage" means a voltage of less than about 1 kV.

In the present description and in the subsequent claims, as "conductor" it is meant a conducting element of elongated shape and preferably of a metallic material, e.g. aluminium or copper.

As "insulating coating" or "insulating layer" it is meant a coating or layer made of a material having an insulation constant ($k_i$) greater than 0.0367 MOhm km (as from IEC 60502).

In the present description and claims, as "silane-crosslinked" it is meant a polyolefin material having siloxane bonds (—Si—O—Si—) as the cross-linking element.

In the present description and claims, as "expanded polyolefin material" it is meant a material with a percentage of free space inside the material, i.e. a space not occupied by the polymeric material, but by gas or air, said percentage being expressed by the "expansion degree" (G), defined as follows:

$$G = \left(\frac{d_0 - d_e}{d_0}\right) \times 100$$

wherein $d_0$ is the density of the unexpanded polymer and $d_e$ is the apparent density measured on the expanded polymer.

The apparent density is measured according to the Italian standard regulation CEI EN 60811-1-3:2001-06.

In the present description and claims, the term "sheath" is intended to identify a protective outer layer of the cable having the function of protecting the latter from accidental impacts or abrasion. From the foregoing, according to the term mentioned above, the cable sheath is not required to provide the cable with specific electrical insulating properties.

In the present description and claims as "silane-based cross-linking system" it is meant a compound or a mixture of compounds comprising at least one organic silane.

In the present description and claims as "foaming system" it is meant a compound or mixture of compounds comprising one ore more foaming agents, of which at least one is an exothermic foaming agent.

In the present description and claims, as "endothermic foaming agent" is meant a compound or a mixture of compounds which is thermally unstable and causes heat to be absorbed while generating gas and heat at a predetermined temperature.

In the present description and claims, as "exothermic foaming agent" is meant a compound or a mixture of compounds which is thermally unstable and decompose to yield gas and heat at a predetermined temperature.

In the present description and claims, as "draw down ratio" it is meant the ratio of the thickness of the extruder die opening to the final thickness of the extruded product.

In a first aspect, the present invention relates to a process for manufacturing an electric cable comprising at least one core comprising a conductor and an insulating coating surrounding said conductor, said process comprising the steps of:

- providing a polyolefin material, a silane-based cross-linking system and a foaming system comprising at least one exothermic foaming agent in an amount of from 0.1% to 0.5% by weight with respect to the total weight of the polyolefin material;
- forming a blend with the polyolefin material, the silane-based cross-linking system and the foaming system;
- extruding the blend on the conductor to form the insulating coating.

As "polyolefin material" it is meant a polymer selected from the group comprising: polyolefins, copolymers of various olefins, olefins/unsaturated esters copolymers, polyesters, and mixtures thereof. Preferably, said polyolefin material is: polyethylene (PE), in particular low-density PE (LDPE), medium-density PE (MDPE), high-density PE (HDPE) and linear low-density PE (LLDPE); ethylene-propylene elastomeric copolymers (EPM) or ethylene-propylene-diene terpolymers (EPDM); ethylene/vinyl ester copolymers, for example ethylene/vinyl acetate (EVA); ethylene/acrylate copolymers; ethylene/α-olefin thermoplastic copolymers; and their copolymers or mechanical blends.

More preferred according to the invention is a polyolefin material selected from polyethylene (PE), in particular low-density PE (LDPE), medium-density PE (MDPE), high-density PE (HDPE) and linear low-density PE (LLDPE), more preferably LLDPE, optionally in blend with EPDM or olefin copolymer.

When the polyolefin material of the invention is a blend of a polyethylene material and a copolymer material, the latter is advantageously present in an amount of from 5 phr to 30 phr.

Preferred silanes that can be used are the ($C_1$-$C_4$)alkyloxy silanes with at least one double bond, and in particular vinyl- or acryl-($C_1$-$C_4$)alkyloxy silanes; compounds suitable for the purpose can be γ-methacryloxy-propyltrimethoxy silane, vinyltrimethoxysilane, vinyltriethoxysilane, vinyldimethoxyethoxysilane, vinyltris-(2-methoxyethoxy) silane, and mixtures thereof.

The silane-based cross-linking system for the process of the invention comprises at least one peroxide. Preferably, peroxides that can be advantageously used are di(terbutylperoxypropyl-(2)-benzene, dicumyl peroxide, di-terbutyl peroxide, benzoyl peroxide, ter-butylcumyl peroxide, 1,1-di(terbutylperoxy)-3,3,5-trimethyl-cyclohexane, 2,5-bis (terbutylperoxy)-2,5-dimethylhexane, 2,5-bis (terbutylperoxy)-2,5-dimethylhexine terbutylperoxy-3,5,5-trimethylhexanoate, ethyl 3,3-di(terbutylperoxy)butyrate, butyl-4,4-di(terbutylperoxy)valerate, and terbutylperoxybenzoate.

Preferably, the silane-based cross-linking system for the process of the invention comprises at least one cross-linking catalyst, which is chosen from those known in the art; preferably, it is convenient to use an organic titanate or a metallic carboxylate. Dibutyltin dilaurate (DBTL) is especially preferred.

Advantageously, the amount of silane cross-linking system is such to provide the blend with from 0.003 to 0.015 mol of silane per 100 grams of polyolefin material. Preferably the amount of silane is of from 0.006 to 0.010 mol of silane per 100 grams of polyolefin material.

Optionally the foaming system of the present process comprises at least one endothermic foaming agent, preferably in an amount equal to or lower than 20% by weight with respect to the total weight of the polyolefin material.

Advantageously, the exothermic foaming agent for the process of the invention is an azo compound such as azodicarbonamide, azobisisobutyronitrile, and diazoaminobenzene. Preferably, the exothermic foaming agent is azodicarbonamide.

Preferably, the exothermic foaming agent is in an amount of from 0.15% to 0.24% by weight with respect to the total weight of the polyolefin material.

Advantageously the foaming system is added to the polyolefinic material as a masterbatch comprising a polymer material, preferably, an ethylene homopolymer or copolymer such as ethylene/vinyl acetate copolymer (EVA), ethylene-propylene copolymer (EPR) and ethylene/butyl acrylate copolymer (EBA). Said masterbatch comprises an amount of foaming agent (exothermic and, in case, endothermic) of from 1% by weight to 80% by weight, preferably of from 5% by weight to 50% by weight, more preferably of from 10% by weight to 40% by weight, with respect to the total weight of the polymer material.

Advantageously, the foaming system further comprises at least one activator (a.k.a. kicker). Preferably, suitable activators for the foaming system of the invention are transition metal compounds.

Optionally, the foaming system of the process of the invention further comprises at least one nucleating agent. Preferably the nucleating agent is an active nucleator.

Advantageously, the process of the present invention is carried out in a single screw extruder.

Preferably, the step of extruding the blend on the cable conductor for providing such conductor of an insulating layer comprises the steps of feeding said conductor to an extruding machine;

depositing the insulating layer by extrusion.

Advantageously, the step of extruding the blend is effected by means of a die with a reduced diameter, according to the "draw down ratio" (DDR) lower than 1, preferably lower than 0.9, more preferably lower than 0.8.

Optionally, the manufacturing process according to the invention further comprises the step of providing a sheath layer in a radially circumferential external position with respect to the at least one conductor coated with the relevant insulating layer. Such a step is carried out by extrusion.

In another aspect the present invention relates to an electric cable comprising at least one core consisting of a conductor and an insulating coating surrounding said conductor and in contact therewith, said insulating coating consisting essentially of a layer of expanded, silane-crosslinked polyolefin material having an expansion degree of from 3% to 40%.

Preferably, the electric cable of the invention has three cores as described above.

The electric cable according to the invention is preferably a low voltage cable.

As "polyolefin material" it is meant a polymer selected from the group comprising: polyolefins, copolymers of various olefins, olefins/unsaturated esters copolymers, polyesters, and mixtures thereof. Preferably, said polyolefin material is: polyethylene (PE), in particular low-density PE (LDPE), medium-density PE (MDPE), high-density PE (HDPE) and linear low-density PE (LLDPE); ethylene-propylene elastomeric copolymers (EPM) or ethylene-propylene-diene terpolymers (EPDM); ethylene/vinyl ester copolymers, for example ethylene/vinyl acetate (EVA); ethylene/acrylate copolymers; ethylene/α-olefin thermoplastic copolymers; and their copolymers or mechanical blends.

More preferred according to the invention is a polyolefin material selected from polyethylene (PE), in particular low-density PE (LDPE), medium-density PE (MDPE), high-density PE (HDPE) and linear low-density PE (LLDPE), more preferably LLDPE, optionally in blend with EPDM or olefin copolymer.

When the polyolefin material of the invention is a blend of a polyethylene material and a copolymer material, the latter is advantageously present in an amount of from 5 phr to 30 phr.

More preferably, the insulating coating for the cable of the invention has an expansion degree of from 5% to 30%, even more preferably of from 10% to 25%.

Advantageously the insulating coating of the cable of the invention shows an expansion characterized by a specific average cell diameter.

In particular, the insulating coating of the cable of the invention advantageously has an average cell diameter equal to or lower than 300 μm, preferably equal to or lower than 100 μm.

Advantageously, the insulating coating of the invention is not expanded in a circumferential portion in contact with and/or in the vicinity of the conductor, i.e. substantially no cells are present therein.

Preferably, the cable according to the present invention is provided with a sheath layer, in radially external position with respect to the insulating layer, preferably in contact thereto.

Preferably, said sheath layer is made of a compound comprising polyvinyl chloride (PVC), a filler, such as chalk, a plasticizer, e.g. octyl, nonyl or decyl phthalate, and additives.

In a further aspect, the present invention relates to a method for improving the ageing stability of a cable comprising a conductor, an insulating layer and a sheath, wherein the said insulating coating comprises a silane-crosslinked polyolefin material having an expansion degree of from 3% to 40%.

BRIEF DESCRIPTION OF THE DRAWINGS

Further characteristics and advantages will become clearer in the light of the following description of some preferred embodiments of the present invention.

The following description makes reference to the accompanying drawings, in which.

DETAILED DESCRIPTION OF THE PREFERRED EMBODIMENTS

Figure 1:
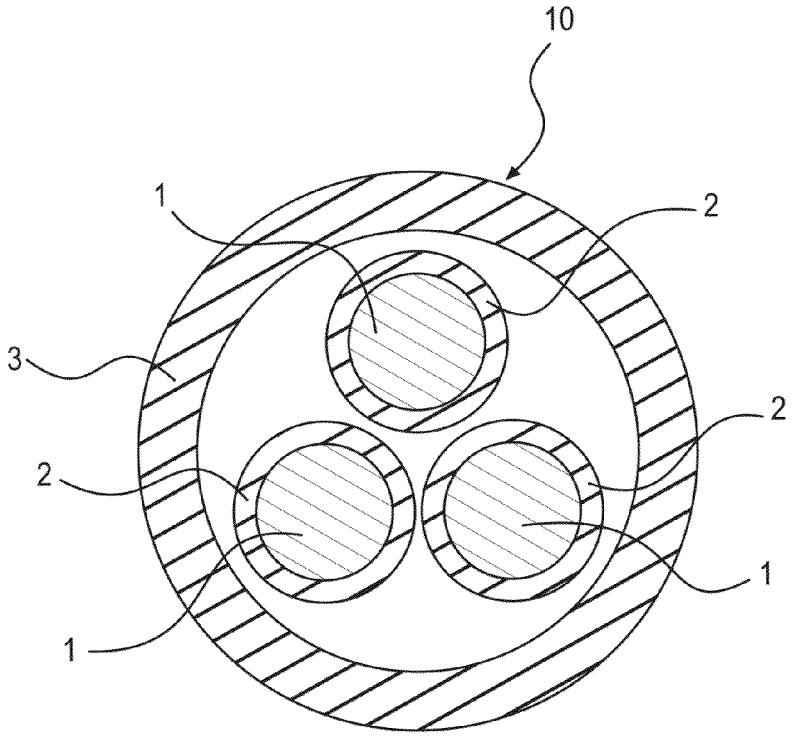
FIG. 1 shows a cross right section of an example of a cable according to the present invention.

FIG. 1 shows the cross section of a cable according to the invention for power transmission at low voltage.

Cable 10 is of the tripolar type (with three cores) and comprises three conductors 1 each covered by an expanded and cross-linked polymer insulating coating 2. The three conductors 1 with the relevant insulating coatings are encircled by a sheath 3.

The insulating constant $k_i$ of the electrical insulating layer 2 is such that the required electric insulating properties are compatible with the standards (e.g. IEC 60502 or other equivalent thereto). For instance, the electrical insulating layer 2 has an insulating constant $k_i$ equal to or greater than 3.67 MOhm km at 90° C.

The expansion degree of the insulating layer for the cable of the invention is of from 3% to 40%. In particular, the Applicant observed that an expansion degree lower than 3% does not provide the cable with appreciable advantages in term of flexibility and weight reduction. On the other side when the expansion degree is higher than 40%, the mechanical characteristics of the cable, e.g. the tensile strength are impaired to an extent unacceptable for the installation requirement.

FIG. 1 shows only one of the possible embodiments of cables in which the present invention can be advantageously employed. Therefore, any suitable modifications can be made to the embodiments mentioned above such as, for example, the use of cables of the multipolar type or conductors of sectorial cross section.

According to the present invention, in order to confer to the insulating coating a suitable mechanical resistance without decreasing the flexibility of the cable, the expanded polyolefin material of thereof is obtained from a polyolefin material that, before expansion, has a flexural modulus at room temperature, measured according to ASTM standard D790-86, comprised between 50 MPa and 1,000 MPa. Preferably, said flexural modulus at room temperature is not greater than 600 MPa, more preferably it is comprised between 100 MPa and 600 MPa.

For example, the cable of FIG. 1 can be produced by a process carried out in an extrusion apparatus with a single screw extruder having a diameter of from 60 to 175 mm, and a length about 20 D to 30 D, these characteristics being selected in view of the diameter of the cable to be obtained and/or of the desired speed production.

Suitably, the screw can be a single flight screw, with the optional presence of barrier flight in the transition zone; preferably no mixer device is adopted along the screw.

The extrusion apparatus is advantageously fed by a multi component dosing system of gravimetric type or, preferably, of volumetric type. The dosing system can feed the ingredients (polyolefin material, silane-based cross-linking system and foaming system).

If a colored cable is desired (either wholly colored or provided with a colored skin coating), a pigment master batch can used.

The above-mentioned ingredients are advantageously fed to the feeding throat of the extruder in pellet form and dosed in the desired percentage through a gravimetric or volumetric control system. A preliminary mixing of the ingredients, off-line or in the hopper above the feed throat, can advantageously improve the dispersion of components and the final product quality.

Optionally, the cross-linking system, typically available in liquid state, is introduced in the extruder by injecting it at the bottom of extruder hopper (top of feeding throat) at low pressure (1 bar); the percentage of cross-linking system introduced can be gravimetrically or volumetrically checked.

For example, the above listed ingredients are fed in the extruder throat, heated, melted and mixed by the screw along the extruder and finally metered to the extrusion crosshead.

Along the extruder, the grafting of silane groups to polymeric chains is chemically activated and the cross-linking process starts.

The expansion of the polyolefin material for the insulating coating of the invention is accomplished by means of a specific foaming agent. Such foaming agent is advantageously selected from the group of the exothermic foaming agent, in particular of the azo compounds such as azodicarbonamide, azobisisobutyronitrile, and diazoaminobenzene. The azo compounds are preferred foaming agent by virtue of their chemical inertia with respect to reactants employed in the preparation of the insulating coating, especially with respect to the cross-linking system.

The foaming system is blended with the other ingredients and start to decompose at a predetermined temperature. After reaction, the gas generated by the foaming system remains dispersed inside the blend.

The blend, after passing through the filtration unit, is fed, for example, to a crosshead where it is distributed around the conductor in an orthogonal configuration with respect to the extruder. In the die zone, the conductor is coated by the blend and, after the dies when the pressure is released, the expansion of the blend starts; After a length of, e.g., 1 m where the coated conductor is exposed to ambient, the same is plunged in the cooling through, where it is subject to cooling by turbulent water or other similar cooling liquid. The cooling through can be of single pass or multi pass type.

The expansion phase of the extruded insulating layer is stopped as soon as the melt is cooled down, so it should happen in a short time.

At the end of the cooling unit the insulated conductor is dried, for example, by use of air jet system or heating, and subsequently taken up on drums.

At this stage, the cross-linking of the insulating coating goes on optionally with the aid of water and temperature; the time delay for completing of the cross-linking phase can be reduced by placing a drum with the insulated conductor inside a curing room (sauna).

The step of extruding the blend can be effected by means of a die with a reduced diameter, according to the "draw down ratio" (DDR), in order to increase the compression on the melted compound and obtain an expansion with improved regularity and dimension of the cells.

As from above, in the present process the exothermic foaming agent is in an amount of from 0.1% to 0.5% by weight with respect to the total weight of the polyolefin material. Amounts lower than 0.1% by weight yield negligible expansion degrees of the polyolefin material. On the other side, as it will be shown in the accompanying examples, amounts higher than 0.5% by weight yield expansion degrees so high to impair the mechanical characteristics of the products.

The foaming system of the invention can further comprise at least one activator, for example zinc-, cadmium- or lead-compounds (oxides, salts, usually of a fatty acid, or other organometallic compounds) amines, amides and glycols.

The foaming system of the process of the invention can further comprise at least one nucleating agent. The nucleating agent provides nucleating sites where the physical foaming agent will come out of solution during foam expansion; a nucleating site means a starting point from where the foam cells start growing. If a nucleating agent can provide a higher number of nucleating sites then more cells are formed and the average cell size will be smaller.

Two types of nucleating agents can be used in the process of the invention, inactive (or passive) and active nucleators. Inactive nucleators include solid materials with fine particle size such as talc, clay, diatomaceous earth, calcium carbonate, magnesium oxide and silica. These materials function as nucleators by providing an interruption in the system when the foaming agent comes out of solution to start a bubble. The efficiency of these materials is effected by the shape and size of the particle. Chemical foaming agents, materials which generate gas upon decomposition, e.g. azodicarbonamide, can also act as active nucleators. The nucleation of direct gassed systems with chemical foaming agents is called "active nucleation". Active nucleators are preferable as more efficient and providing smaller and more uniform cells versus inactive nucleators.

The amount of silane cross-linking system is such to provide the blend with from 0.003 to 0.015 mol of silane per 100 grams of polyolefin material. An amount of silane lower than 0.003 mol of silane does not provide a sufficient cross-linking of the polyolefin material, while an amount higher than 0.015 mol, besides being in large excess, can cause screw slipping in the extruder.

EXAMPLE 1

Low-voltage cables, both according to the present invention and not, were prepared according to the cable design shown in FIG. 1.

The cable conductor 1 was made of copper and had a cross section of about 1.5 $mm^2$.

| | | | | | | | | | | |
|---|---|---|---|---|---|---|---|---|---|---|
| Main extruder size: | | | 150/26D | | | | | | | |
| Tip die: | | | 1.38 mm | | | | | | | |
| Ring die: | | | 2.70 mm | | | | | | | |
| Foaming mb dosing system: | | | Maguire (gravimetric type) | | | | | | | |
| Temperature Profile (° C.): | | | | | | | | | | |
| Z1 | Z2 | Z3 | Z4 | Z5 | Z6 | H1 | H2 | H3 | H4 | |
| 160 | 180 | 190 | 200 | 210 | 220 | 220 | 230 | 240 | 240 | |
| Line speed: | | | 1500 m/min | | | | | | | |
| Main extruder speed: | | | 48 rpm | | | | | | | |
| current: | | | 65 A | | | | | | | |
| pressure: | | | 380 bar | | | | | | | |
| Hot cable diameter: | | | 2.9 mm | | | | | | | |
| Cold cable diameter: | | | 2.9 mm | | | | | | | |

The thickness of each insulating coating was about 0.6 mm. 0.7 mm in accordance with Italian Standard CEI-UNEL 35752 (2nd Edition—February 1990).

Each cable was subsequently cooled in water and wound on a storage reel.

Table 1 also set forth the expansion degrees of each polymeric blend.

TABLE 1

| | | Crosslinking system | | Foaming agent | | Expansion | |
|---|---|---|---|---|---|---|---|
| Cable | Polyolefin | Kind | Mol | Kind | % w/w | Density ($g/cm^3$) | Degree (%) |
| 1 | LL4004 EL | Sil/perox | 0.01 | — | — | 0.926 | 0.0 |
| 2 | LL4004 EL | Sil/perox | 0.01 | Hostatron | 0.27 | 0.628 | 32.2 |
| 3 | BPD 3220 | Silfin 06 | 0.006 | — | — | 0.903 | 0.0 |
| 4 | BPD 3220 | Silfin 06 | 0.006 | Hostatron | 0.24 | 0.700 | 22.2 |
| 5 | BPD 3220 | Silfin 06 | 0.006 | Hostatron | 0.15 | 0.860 | 4.4 |
| 6 | BPD 3220 | Silfin 06 | 0.008 | Hostatron | 0.15 | 0.850 | 5.6 |
| 7 | BPD 3220 | Silfin 06 | 0.006 | Hostatron 50% | 0.15 | 0.817 | 9.5 |
| 8 | BPD 3220 | Silfin 06 | 0.006 | Hostatron 50% | 0.18 | 0.764 | 15.4 |
| 9 | BPD 3220 | Silfin 06 | 0.006 | Hostatron | 0.18 | 0.787 | 12.8 |
| 10 | BPD 3220 | Sil/perox | 0.006 | Hostatron | 0.24 | 0.711 | 21.5 |
| 11* | BPD 3220 | Sil/perox | 0.12 | Hostatron | 0.09 | 0.906 | 0.3 |
| 12 | BPD 3220 | Sil/perox | 0.12 | Hostatron | 0.18 | 0.833 | 8.1 |
| 13 | BPD 3220 | Sil/perox | 0.12 | Hostatron | 0.24 | 0.694 | 23.4 |
| 14* | BPD 3220 | Sil/perox | 0.006 | Hostatron 50% | 0.60 | 0.481 | 48.0 |
| 15* | LL4004 EL | Sil/perox | 0.01 | Hydrocerol | 0.40 | 0.611 | 34.0 |
| 16* | BPD 3220 | Silfin 06 | 0.006 | Hydrocerol | 0.16 | 0.876 | 3.0 |
| 17* | BPD 3220 | Silfin 06 | 0.006 | Hydrocerol | 0.45 | 0.570 | 15.4 |
| 18 | BPD 3220 | Sil/perox | 0.006 | Hostatron 50% | 0.24 | 0.764 | 38.0 |

N.B. - the mol and % w/w refer to the content of, respectively, silane or foaming agent The cables marked with an asterisk are comparative ones.

LL 4004 EL = LLDPE with an MFL of 0.33 g/10 min at 190° C. under a load of 2.16 kg (by ExxonMobil Chemical)

BPD 3220 = LLDPE (by BP)

TABLE 1-continued

| Cable | Polyolefin | Crosslinking system Kind | Mol | Foaming agent Kind | % w/w | Expansion Density (g/cm$^3$) | Degree (%) |
|---|---|---|---|---|---|---|---|

Sil/perox = LUPEROX 801 (by Arkema) plus DYNASYLAN VTMO (by Degussa)

Silfin 06 = mixture of vinylsilane, peroxide initiator and catalyst for crosslinking (by Degussa)

Hostatron = PV22167 foaming system based on azodicarbonamide foaming agent (by Clariant)

Hostatron 50% = PV22167 foaming system based on azodicarbonamide foaming agent (by Clariant) at 50% in EVA masterbatch Hydrocerol = BIH 40, foaming system based on a mixture of citric acid and basic sodium carbonate as foaming agents (by Clariant).

The composition of said blends is shown in Table 1 (expressed in parts by weight per 100 parts by weight of base polymer).

The % w/w of the foaming agent refers to the amount of foaming agent added.

Cables 1 and 3 (no foaming agent used) are provided as reference for calculating the expansion degree, and for the electrical testing the cables with the crosslinked and expanded insulating layer.

Cables 15*-17* relates are insulated by polymeric blends expanded with an endothermic foaming agent (Hydrocerol)

Cables 11* and 14* are insulated by polymeric blends expanded with an exothermic foaming agent in an amount out of the preferred range. In the case of Cable 11, the expansion degree is substantially null, thus this cable is not endowed with advantages in term of flexibility and peel-off capacity with respect to a cable having a non-expanded insulating coating. On the other side, Cable 14 shows an insulating coating with an expansion degree too high and impairing the mechanical properties, as it will be shown in the Example 3.

EXAMPLE 2

Cables as from example 1 were tested to evaluate the cross-linking degree of the insulating coating thereof, according to the Italian standard regulation CEI EN 60811-2-1:1999-05. The results are set forth in Table 2.

TABLE 2

| Cable | Expansion Density (g/cm$^3$) | Degree (%) | Hot set Elongation (%) |
|---|---|---|---|
| 1 | 0.926 | 0.0 | 45 |
| 2 | 0.628 | 32.2 | 50 |
| 3 | 0.903 | 0.0 | 90 |
| 4 | 0.700 | 22.2 | 110 |
| 5 | 0.860 | 4.4 | 75 |
| 6 | 0.850 | 5.6 | 85 |
| 8 | 0.764 | 15.4 | 100 |
| 9 | 0.787 | 12.8 | 90 |
| 10 | 0.711 | 21.5 | 107 |
| 12 | 0.833 | 8.1 | 35 |
| 13 | 0.694 | 23.4 | 45 |
| 14* | 0.481 | 48.0 | 110 |
| 15* | 0.611 | 34.0 | 60 |
| 16* | 0.876 | 3.0 | >200 |
| 17* | 0.764 | 15.4 | broken |
| 18 | 0.570 | 38.0 | 50 |

The cables marked with an asterisk are comparative ones.

Figure 2:
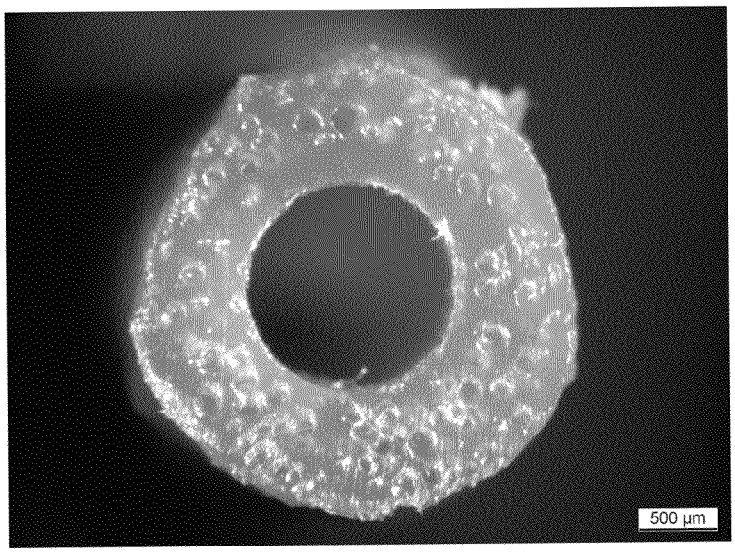
FIG. 2 is a photograph of a sample of insulating layer from comparative cable 17.

Taking into account that the limit prescribed by the above mentioned requirement is up to 175%, Cable 16* shown to be out of scale, i.e. the polyolefin did not cross-link sufficiently and this negatively affects the thermopressure resistance. Cable 17* broke due to an excessive average cell diameter and to an irregular cell distribution in the expanded polyolefin, as shown in FIG. 2. The two failures reported in Table 2 is ascribed to the use of an endothermic foaming agent as the sole foaming agent of the process for producing a cross-linked and expanded polyolefin material. The endothermic foaming agent could negatively interact with the silane-based cross-linking system.

EXAMPLE 3

Cables produced as from example 1 were tested in order to measure the mechanical properties thereof, according to the Italian standard regulation CEI EN 60811-1-1:2001-06, requiring a tensile strength of at least 12.5 MPa. The results are set forth in Table 3.

TABLE 3

| Cable | Expansion Density (g/cm$^3$) | Degree (%) | Tensile Strength MPa |
|---|---|---|---|
| 1 | 0.926 | 0.0 | 20.00 |
| 2 | 0.628 | 32.2 | 12.50 |
| 3 | 0.903 | 0.0 | 20.54 |
| 4 | 0.700 | 22.2 | 13.57 |
| 5 | 0.860 | 4.4 | 17.37 |
| 6 | 0.850 | 5.6 | 18.92 |
| 8 | 0.764 | 15.4 | 16.43 |
| 9 | 0.787 | 12.8 | 17.02 |
| 10 | 0.711 | 21.5 | 18.90 |
| 12 | 0.833 | 8.1 | 18.10 |
| 13 | 0.694 | 23.4 | 14.10 |
| 14* | 0.481 | 48.0 | 9.70 |
| 15* | 0.611 | 34.0 | 9.20 |
| 18 | 0.570 | 38.0 | 12.80 |

The cables marked with an asterisk are comparative ones.

Cable 14* insulated by a polymeric blends expanded with an exothermic foaming agent according to the invention but in an amount out (higher) of the selected range, and providing an insulating coating with an expansion degree (48.0%) not according to the invention. Such cable showed unsuitable mechanical features.

Cable 15* insulated by a polymeric blends expanded with an endothermic foaming agent and provided with an insulating coating having an expansion degree in the range of the invention (34.0%) showed anyway poor mechanical features. This is due to the use of an endothermic foaming agent that yield an expansion degree unsatisfactory from the qualitatively point of view.

EXAMPLE 4

In the following Table 4 the mechanical properties and the hot set of two cables according to the invention and one comparative cable were evaluated together with the average cell diameter.

The average cell diameter was evaluated as follows. An expanded portion of insulating coating was randomly selected and cut perpendicularly to the longitudinal axis. The cut surface was observed by a microscope and the image was formed on a photograph. The major diameter (taking into account that the cells can be not perfectly round) of 50 randomly selected cells was measured. The arithmetic mean of the 50 measured diameters represents the average cell diameter.

For each cable two samples were tested. All of the cables differed from those of the previous examples just in that conductor 1 had a cross section of about 2.5 mm$^2$.

The insulation coatings for cables 17* and 19 were extruded with a DDR=1, the insulation coating for cable 20 was extruded with a DDR=0.7.

The draw down ratio was calculated by comparing the cross sectional area of the die to the cross sectional area of the extrusion. The following formula was applied:

$$DDR = \frac{D_d^2 - D_m^2}{D_t^2 - D_b^2}$$

wherein DDR=draw down ratio
$D_d$=Internal diameter of extrusion ring-die
$D_m$=External diameter of the tip-die
$D_t$=External diameter tube
$D_b$=Internal diameter tube.

TABLE 4

| Cable | Polyolefin | Foaming agent Kind | Foaming agent % w/w | Expansion degree (%) | Average cell diameter μm | Mechanical properties TS (MPa) | Mechanical properties EB (%) | Hot set Elongation (%) |
|---|---|---|---|---|---|---|---|---|
| 17* | BPD 3220 | Hydrocerol | 0.24 | 15.4 | 500 | 11.03 | 486.5 | both broken |
| 19 | BPD 3220 | Hostatron 50% | 0.18 | 13 | 300 | 15.61 | 580.6 | 90; 100 |
| 20 | BPD 3220 | Hostatron 50% | 0.18 | 13 | 100 | 17.15 | 573.3 | 80; 80 |

Figure 3:
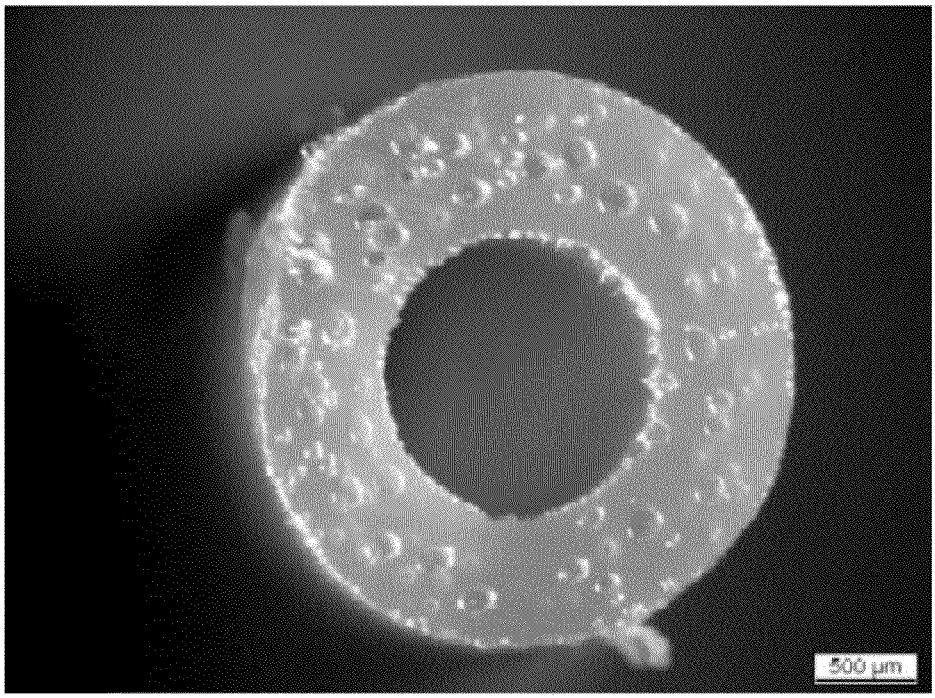
FIG. 3 is a photograph of a sample of insulating layer from cable 19 according to the invention.
Figure 4:
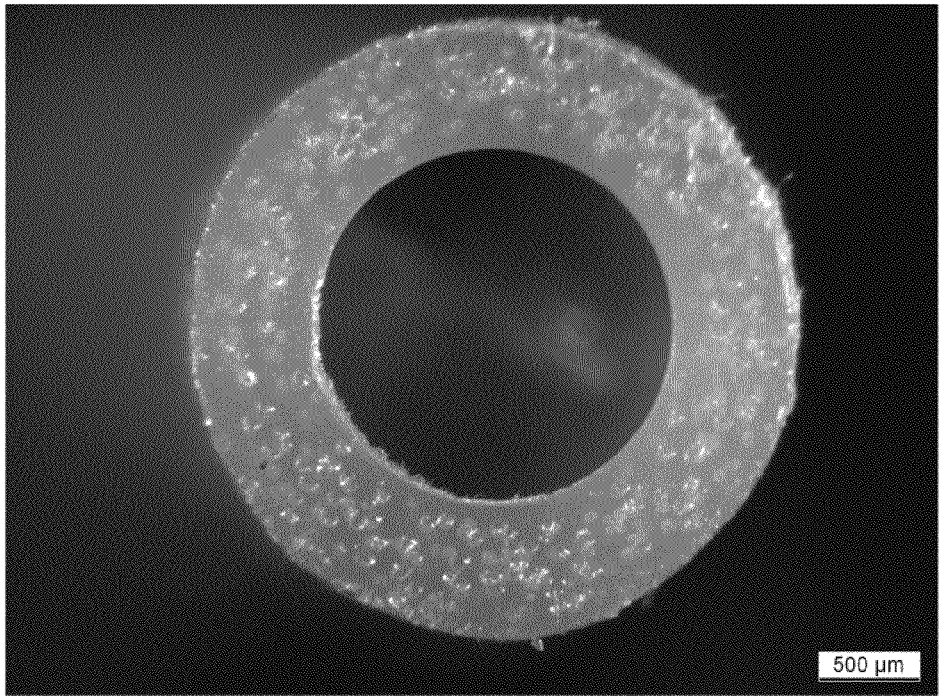
FIG. 4 is a photograph of a sample of insulating layer from cable 20 according to the invention.

TS = Tensile strength
EB = Elongation at break
The cables marked with an asterisk are comparative ones.
The decreasing of the average cell diameter was found to improve the mechanical characteristics, such as hot set and tensile strength, of the insulating layer.
Cable 17* insulation have an expansion degree similar to that of the cables of the invention, but the average cell diameter is higher. The high average cell diameter of cable 17* is accompanied by an uneven e expansion, as visible in FIG. 2. Cables 19 and 20 according to the invention have improved mechanical properties with respect of the comparative Cable 17*. In particular, Cable 20 has the same expansion degree of Cable 19, but a lower average cell diameter due to the lower extrusion DDR and is endowed with a superior tensile strength. Said cables are shown in FIGS. 3 and 4, respectively.

EXAMPLE 5

A cables as from example 4 was tested in order to measure the ease of peeling-off the insulating coating material from the conductor, in comparison with an unexpanded cable 3.

Six 120 mm-long samples for each cable were provided. Each sample was previously peeled-off to an extent of 40 mm, so as 80 mm of sample were employed in the test, effected according to MIL-W-22759

The results are set forth in the following Table 5.

TABLE 5

| Cable | Expansion Degree (%) | peeling-off (sfilability test) max load (N) | min load (N) | average load (N) |
|---|---|---|---|---|
| 3 | — | 53.27 | 23.02 | 38.14 |
| 20 | 13 | 16.21 | 10.73 | 13.47 |

The force applied for peeling off the cable of the invention is lower than that for the reference cable 3 having an insulating layer not expanded. The max load is the force applied for starting the peeling-off.

EXAMPLE 6

Three cables produced according to Example 1 and sheathed with PVC containing decyl phthalate as plasticizer (sheath thickness=1.56 mm) were tested to evaluate the mechanical characteristics thereof after 7 days at 100° C. (ageing test according to EN 60811). According to the test requirement the maximum variation of the tensile strength must not excess ±25%. The results are set forth in Table 6.

TABLE 6

| Cable | Expansion Density (g/cm$^3$) | Expansion Degree (%) | Mechanical characteristic Tensile strength (MPa) | Mechanical characteristic Maximum Variation (%) |
|---|---|---|---|---|
| 3 | 0.903 | 0.0 | 19.72 ± 0.49 | −25.3 ± 2.6 |
| 4 | 0.700 | 22.2 | 12.25 ± 0.63 | −12.2 ± 6.4 |
| 5 | 0.860 | 4.4 | 17.72 ± 1.41 | 12.4 ± 4.9 |
| 6 | 0.850 | 5.6 | 18.91 ± 0.79 | −12.4 ± 5.2 |

Cables 4-6 according to the invention passed the test, whereas reference cable 3 having an insulating layer not expanded did not.

The presence of an expanded insulating layer improves the mechanical properties after the compatibility test, decreasing the negative effects of the migration of the plasticizer present in the cable sheath.

The invention claimed is:

1. An electric cable comprising at least one core consisting of a conductor and an insulating coating surrounding said conductor and in contact therewith, said insulating coating consisting of a layer of expanded, silane-crosslinked polyolefin material having an expansion degree of 3% to 40%, wherein said insulating coating has an average cell diameter equal to or lower than 300 μm.

2. The electric cable according to claim 1, which is a low voltage cable.

3. The electric cable according to claim 1, comprising three cores.

4. The electric cable according to claim 1, wherein the polyolefin material is selected from polyolefins, copolymers of olefins, olefins/unsaturated esters copolymers, polyesters, and mixtures thereof.

5. The electric cable according to claim 4, wherein the polyolefin material is selected from low-density polyethylene, medium-density polyethylene, high-density polyethylene, linear low-density polyethylene, ethylene-propylene elastomeric copolymers, ethylene-propylene-diene terpolymers, ethylene/vinyl ester copolymers, ethylene/acrylate copolymers, ethylene/α-olefin thermoplastic copolymers, and copolymers or mechanical blends thereof.

6. The electric cable according to claim 5, wherein the polyolefin material is selected from low-density polyethylene, medium-density polyethylene, high-density polyethylene, linear low-density polyethylene, and a blend thereof with ethylene-propylene-diene terpolymers or olefin copolymers.

7. The electric cable according to claim 6, wherein the polyolefin material is selected from linear low-density polyethylene and the blend thereof with ethylene-propylene-diene terpolymers or olefin copolymers.

8. The electric cable according to claim 6, wherein the polyolefin material is a blend of a polyethylene material and a copolymer material, the copolymer material being present in an amount of from 5 phr to 30 phr.

9. The electric cable according to claim 1, wherein the insulating coating has an expansion degree of 5% to 30%.

10. The electric cable according to claim 9, wherein the insulating coating has an expansion degree of 10% to 25%.

11. The electric cable according to claim 1, wherein the insulating coating has an average cell diameter equal to or lower than 100 μm.

12. The electric cable according to claim 1, wherein a circumferential portion of the expanded insulating coating contacting the conductor is not expanded.

13. The electric cable according to claim 1, comprising a sheath layer, in radially external position with respect to the insulating layer.

14. A method for improving the ageing stability of a cable comprising applying to a conductor, an insulating layer and a sheath, said insulating coating consisting of a silane-cross-linked polyolefin material having an expansion degree of 3% to 40%, wherein said insulating coating has an average cell diameter equal to or lower than 300 μm.

15. A process for manufacturing an electric cable comprising at least one core consisting of a conductor and an insulating coating consisting of a layer of expanded, silane-crosslinked polyolefin material surrounding said conductor, comprising the steps of:

providing a polyolefin material, a silane-based cross-linking system and a foaming system comprising at least one exothermic foaming agent in an amount of 0.1% to 0.5% by weight with respect to the total weight of the polyolefin material;

forming a blend with the polyolefin material, the silane-based cross-linking system and the foaming system;

extruding the blend on the conductor to form the insulating coating; and wherein said insulating coating has an average cell diameter equal to or lower than 300 μm.

16. The process according to claim 15, wherein the polyolefin material is selected from polyolefins, copolymers of olefins, olefins/unsaturated ester copolymers, polyesters, and mixtures thereof.

17. The process according to claim 15, wherein the polyolefin material is selected from low-density polyethylene, medium-density polyethylene, high-density polyethylene, linear low-density polyethylene, ethylene-propylene elastomeric copolymers, ethylene-propylene-diene terpolymers, ethylene/vinyl ester copolymers, ethylene/acrylate copolymers, ethylene/α-olefin thermoplastic copolymers, and the copolymers or mechanical blends thereof.

18. The process according to claim 17, wherein the polyolefin material is selected from low-density polyethylene, medium-density polyethylene, high-density polyethylene, linear low-density polyethylene, and a blend thereof with ethylene-propylene-diene terpolymers or olefin copolymers.

19. The process according to claim 18, wherein the polyolefin material is selected from linear low-density polyethylene and a blend thereof with ethylene-propylene-diene terpolymers or olefin copolymers.

20. The process according to claim 15, wherein the silane-based cross-linking system comprises at least one silane selected from $(C_1\text{-}C_4)$alkyloxy silanes with at least one double bond.

21. The process according to claim 20, wherein the at least one silane is selected from vinyl- and acryl-$(C_1\text{-}C_4)$alkyloxy silanes.

22. The process according to claim 21, wherein the at least one silane is selected from γ-methacryloxy-propyltrimethoxy silane, vinyltrimethoxysilane, vinyltriethoxysilane, vinyldimethoxyethoxysilane, vinyltris-(2-methoxyethoxy) silane, and mixtures thereof.

23. The process according to claim 15, wherein the silane-based cross-linking system comprises at least one peroxide.

24. The process according to claim 23, wherein the at least one peroxide is selected from di(terbutylperoxypropyl-(2)-benzene, dicumyl peroxide, diterbutyl peroxide, benzoyl peroxide, terbutylcumyl peroxide, 1,1-di(ter-butylperoxy)-3,3,5-trimethyl-cyclohexane, 2,5-bis(terbutylperoxy)-2,5-dimethylhexane, 2,5-bis(terbutylperoxy)-2,5-dimethylhexine terbutylperoxy-3,5,5-trimethylhexanoate, ethyl 3,3-di(terbutylperoxy)butyrate, butyl-4,4-di(terbutylperoxy)valerate, and terbutylperoxybenzoate.

25. The process according to claim 15, wherein the silane-based cross-linking system comprises at least one cross-linking catalyst.

26. The process according to claim 25, wherein the at least one cross-linking catalyst is selected from an organic titanate and a metallic carboxylate.

27. The process according to claim 26, wherein the at least one cross-linking catalyst is dibutyltin dilaurate.

28. The process according to claim 15, wherein the silane cross-linking system is added in an amount sufficient to provide the blend with 0.003 to 0.015 mol of silane per 100 grams of polyolefin material.

29. The process according to claim 28, wherein the silane cross-linking system is added in an amount sufficient to provide the blend with 0.006 to 0.010 mol of silane per 100 grams of polyolefin material.

30. The process according to claim 15, wherein the foaming system comprises at least one endothermic foaming agent.

31. The process according to claim 20, wherein the at least one endothermic foaming agent is in an amount equal to or lower than 20% by weight with respect to the total weight of the polyolefin material.

32. The process according to claim 15, wherein the exothermic foaming agent is an azo compound.

33. The process according to claim 32, wherein the azo compound is selected from azodicarbonamide, azobisisobutyronitrile, and diazoaminobenzene.

34. The process according to claim 33, wherein the azo compound is azodicarbonamide.

35. The process according to claim 15, wherein the exothermic foaming agent is in an amount of 0.15% to 0.24% by weight with respect to the total weight of the polyolefin material.

36. The process according to claim 15, wherein the foaming system is added to the polyolefin material as a masterbatch comprising polymer material.

37. The process according to claim 36, wherein the polymer material masterbatch is selected from an ethylene homopolymer and an ethylene copolymer.

38. The process according to claim 37, wherein the polymer material masterbatch is selected from ethylene/vinyl acetate copolymer, ethylene-propylene copolymer and ethylene/butyl acrylate copolymer.

39. The process according to claim 36, wherein the masterbatch comprises 1% by weight to 80% of foaming agent by weight with respect to the total weight of the polymer material.

40. The process according to claim 39, wherein the masterbatch comprises 5% by weight to 50% by weight of foaming agent with respect to the total weight of the polymer material.

41. The process according to claim 40, wherein the masterbatch comprises 10% by weight to 40% by weight of foaming agent with respect to the total weight of the polymer material.

42. The process according to claim 15, wherein the foaming system comprises at least one activator.

43. The process according to claim 42, wherein the at least one activator is selected from transition metal compounds.

44. The process according to claim 15, wherein the foaming system comprises at least one nucleating agent.

45. The process according to claim 44, wherein the at least one nucleating agent is an active nucleator.

46. The process according to claim 15, wherein the step of forming a blend with the polyolefin material, the silane-based cross-linking system and the foaming system is effected in a single screw extruder.

47. The process according to claim 46, wherein the extruder is fed by a multi component dosing system of volumetric type.

48. The process according to claim 15, wherein the step of forming a blend with the polyolefin material, the silane-based cross-linking system and the foaming system is preceded by a step of off-line mixing the polyolefin material, the silane-based cross-linking system and the foaming system.

49. The process according to claim 15, wherein the step of extruding the blend on the conductor for providing said conductor with an insulating coating comprises the steps of:

feeding said conductor to an extruding machine; and depositing the insulating layer by extrusion.

50. The process according to claim 15, wherein the step of extruding the blend is effected by means of a die with a draw down ratio lower than 1.

51. The process according to claim 50, wherein the draw down ratio is lower than 0.9.

52. The process according to claim 51, wherein the draw down ratio is lower than 0.8.

53. The process according to claim 15, comprising the step of extruding a sheath layer in a radially circumferential external position with respect to the at least one conductor coated with the relevant insulating coating.

* * * * *